US007112133B2

(12) United States Patent
Lyons

(10) Patent No.: US 7,112,133 B2
(45) Date of Patent: Sep. 26, 2006

(54) REAL TIME PHYSICAL SYSTEM MODELLING WITH PREDETERMINED OUTCOMES

(75) Inventor: Martin Lyons, Erskineville (GB)

(73) Assignee: Aristocrat Technologies Australia Pty Ltd, Lane Cove (AU)

( * ) Notice: Subject to any disclaimer, the term of this patent is extended or adjusted under 35 U.S.C. 154(b) by 17 days.

(21) Appl. No.: 10/035,597

(22) Filed: Oct. 18, 2001

(65) Prior Publication Data

US 2002/0119815 A1 Aug. 29, 2002

(30) Foreign Application Priority Data

Oct. 25, 2000 (AU) ..... PR1007

(51) Int. Cl.
*A63F 9/24* (2006.01)

(52) U.S. Cl. ..... 463/16; 463/30

(58) Field of Classification Search ..... 273/143 R; 463/1–29, 40–42

See application file for complete search history.

(56) References Cited

U.S. PATENT DOCUMENTS 4,095,795 A * 6/1978 Saxton et al. ..... 463/20
4,573,681 A * 3/1986 Okada ..... 463/21
4,889,339 A * 12/1989 Okada ..... 463/20
5,010,995 A * 4/1991 Okada ..... 463/20
5,074,559 A * 12/1991 Okada ..... 463/21
5,083,785 A * 1/1992 Okada ..... 463/21
5,127,651 A * 7/1992 Okada ..... 273/143 R
5,584,764 A * 12/1996 Inoue ..... 463/20
5,667,219 A * 9/1997 Ishibashi ..... 273/143 R
5,667,439 A * 9/1997 Okada ..... 463/20
5,702,303 A * 12/1997 Takemoto et al. ..... 463/27
6,007,425 A * 12/1999 Takemoto et al. ..... 463/16
6,106,393 A * 8/2000 Sunaga et al. ..... 463/20
6,227,970 B1 * 5/2001 Shimizu et al. ..... 463/20
6,328,648 B1 * 12/2001 Walker et al. ..... 463/20
6,533,660 B1 * 3/2003 Seelig et al. ..... 463/17
6,537,150 B1 * 3/2003 Luciano et al. ..... 463/16
6,769,982 B1 * 8/2004 Brosnan ..... 463/16
2002/0119815 A1 * 8/2002 Lyons ..... 463/16

* cited by examiner

*Primary Examiner*—Julie Brocketti
(74) *Attorney, Agent, or Firm*—Fish & Richardson P.C.

(57) ABSTRACT

A gaming machine 10 includes a simulation system for simulating the playing of a game, the simulation system enabling predetermined starting parameters to be set. A comparator compares an end condition of a simulation run by the simulation system using the starting parameters with a pre-calculated desired outcome of the game. A comparator of a processor of the gaming machine 10 adjusts the starting parameters such that the end condition of the simulation coincides with that of the desired outcome of the game.

17 Claims, 3 Drawing Sheets

REAL TIME PHYSICAL SYSTEM MODELLING WITH PREDETERMINED OUTCOMES

FIELD OF THE INVENTION

This invention relates to a gaming machine. More particularly, the invention relates to a gaming machine including a modelling system for predetermined outcomes of games played on the gaming machine and to a method of displaying an outcome of a game played on a gaming machine.

BACKGROUND TO THE INVENTION

Conventional electronic gaming machines work in the following manner. Each game has a set of rules, known as a combination, and a set of winning and non-winning outcomes. A player makes a wager and starts the game and the machine determines the result of the bet. This determination involves a random number generator (RNG) being used to select one of the winning or non-winning outcomes, of which there could be millions of possibilities, and the game then displaying this outcome in some fashion.

An example of the above would be a video spinning reel game. Once the player presses a "Bet" button, the RNG is used to select a "stopping position" for each of the reels. These are the final positions of the spinning reels, to be displayed at the end of the game. The game software does not immediately display these stopping positions. Rather, it first starts the reels spinning from the previous stopping positions and continues to spin the reels until each of the RNG derived stopping positions comes into view on screen. As each stopping position reaches the correct point on screen, the reels are stopped. Thus, the player gets the impression that the derivation of the final position of each reel was done at the end of the reel spin rather than at the beginning.

The reason why game outcomes should be known before the game cycle finishes is that, in the event of a failure of a machine during the game cycle, it is important that the machine does not alter its behaviour. By predetermining and storing the outcome in non-volatile memory, the machine can ensure that if power is lost during a game cycle then, upon resumption of power, the game can continue to the same conclusion.

Another approach to a predetermined outcome would be to model a physical system using software within the gaming machine. In the example of a keno or bingo game, the previous predetermined method would be for the software to select a ball which is going to be produced from the on-screen cage, and then display an animation of this outcome occurring. The problem with this method is that, unless a large number of animations are stored, it quickly becomes apparent that this is not an accurate simulation of a keno game. Modelling the physical system using software would mean, in the case of keno, starting all of the 40 or so virtual "balls" at random positions within a virtual "cage". The simulation software would then simulate the effects of gravity, collisions and all the other forces which would cause the balls to move around randomly within the cage. As the simulation progressed, it would be represented on the gaming machine's screen. At the end of the simulation one of the balls would be "picked" by the simulation which displays a graphical representation of a mechanical arm picking the ball in an analogous way to the way conventional physical lottery machines work.

This approach has some advantages. It would produce a much more realistic looking display of a keno game and would appear to the player to be far more random. Unfortunately, this very randomness would also make it far more difficult for the game software to accurately know which ball is going to be selected, since selection takes place at the end, not the beginning, of the simulation. It would therefore be up to the gaming machine manufacturer to try and prove that the physical system being modelled was sufficiently random in its outcome and, more importantly, free of bias.

Modelling physical processes is relatively straightforward, but the interactions are such that, although it is easy to model from a starting position to derive an ending position—so it is easy to model a ball being dropped on a roulette wheel and then run the simulation through till the ball stops and see where it stops, it is much more difficult to start with an end position and try to derive the starting position that lead to the end position. In the case of roulette this would be akin to trying to derive a starting position, velocity and acceleration for a roulette ball in the croupier's hand from an end position that was at rest and in one of the numbered slots on the roulette wheel. Clearly, this would be an exceptionally difficult task.

Also, roulette is a good example of the problem of bias. Casinos must guard against any charge of bias by using roulette wheels that are made to the highest quality and checked on a regular basis. Any attempt at accurately modelling a roulette wheel system using a computer would also suffer from this need to ensure that the software would not tend to favour any of the possible outcomes for the game. Since gaming machines are heavily regulated, it would be necessary for a gaming machine manufacturer using a physical simulation game to prove that no bias was present to regulators before such a machine could be authorised for sale. Given the complexity of any non-trivial physical simulation, this proof would be hard to furnish.

SUMMARY OF THE INVENTION

According to a first aspect of the invention, there is provided a gaming machine which includes:

a simulation system for simulating the playing of a game, the simulation system enabling predetermined starting parameters to be set;

a comparator for comparing an end condition of a simulation run by the simulation system using the starting parameters with a pre-calculated desired outcome of the game; and an adjustment means for adjusting the starting parameters such that the end condition of the simulation coincides with that of the desired outcome of the game.

The simulation system is, preferably, software based or it may be hardware based. Further, the simulation system may be used as a means to drive a display of a graphical outcome for the game.

The gaming machine may include a control means for controlling playing of the game. At least part of the control means may include a random number generator for generating random numbers. In the case of a spinning reel game, as described above, this random number generator may generate stopping positions for reels or, more accurately, video simulations of the reels of the spinning reel game. The random number generator may be one of a pseudo-random number generator and a hardware based random number generator.

The simulation system may be implemented in the control means by a processing means having sufficient capacity to compute each time slice of the simulation in a timely manner.

The processing mean may include simulation software to perform the simulation and running of iterations of the simulation. More particularly, the simulation software may set random starting parameters for the simulation. These parameters may fall within ranges that are known to produce pleasingly random looking results.

According to a second aspect of the invention, there is provided a method of displaying an outcome of a game played on a gaming machine, the method including the steps of:

setting predetermined starting parameters for a simulation of the game;

determining an end condition of the simulation;

deriving a desired outcome for the game;

comparing the end condition of the simulation with the desired outcome;

adjusting the previously set starting parameters of the simulation as a result of the comparison; and re-running the simulation such that its end condition coincides with the desired outcome of the game.

The method may include setting random starting parameters for the simulation.

The method may then include running the simulation through once until the end condition is arrived at, without displaying the end condition on a display means of the gaming machine. Thereafter, or simultaneously with the running of the simulation, the method may include performing one of a pseudo-random calculation and a truly random calculation to derive the desired outcome for the game as would be done with a conventional gaming machine.

Once the simulation's end condition has been arrived at and the desired outcome for the game has been determined, the method may include adjusting the starting parameters by one of a discrete amount and a mapping function. Hence, the method may include adjusting the starting parameters using a difference between the now known end condition of the simulation and the determined, desired outcome for the game.

The method may include re-running the simulation using the new starting parameters. Preferably, the method includes displaying the rerunning simulation as the simulation progresses. Since the starting parameters have been adjusted so that the end condition of the simulation coincides with the desired outcome of the game, once the simulation ends, the gaming machine will be in its correct end state for the desired outcome.

BRIEF DESCRIPTION OF THE DRAWINGS

The invention is now described by way of example with reference to the accompanying diagrammatic drawings in which.

DETAILED DESCRIPTION OF THE DRAWINGS

Figure 1:
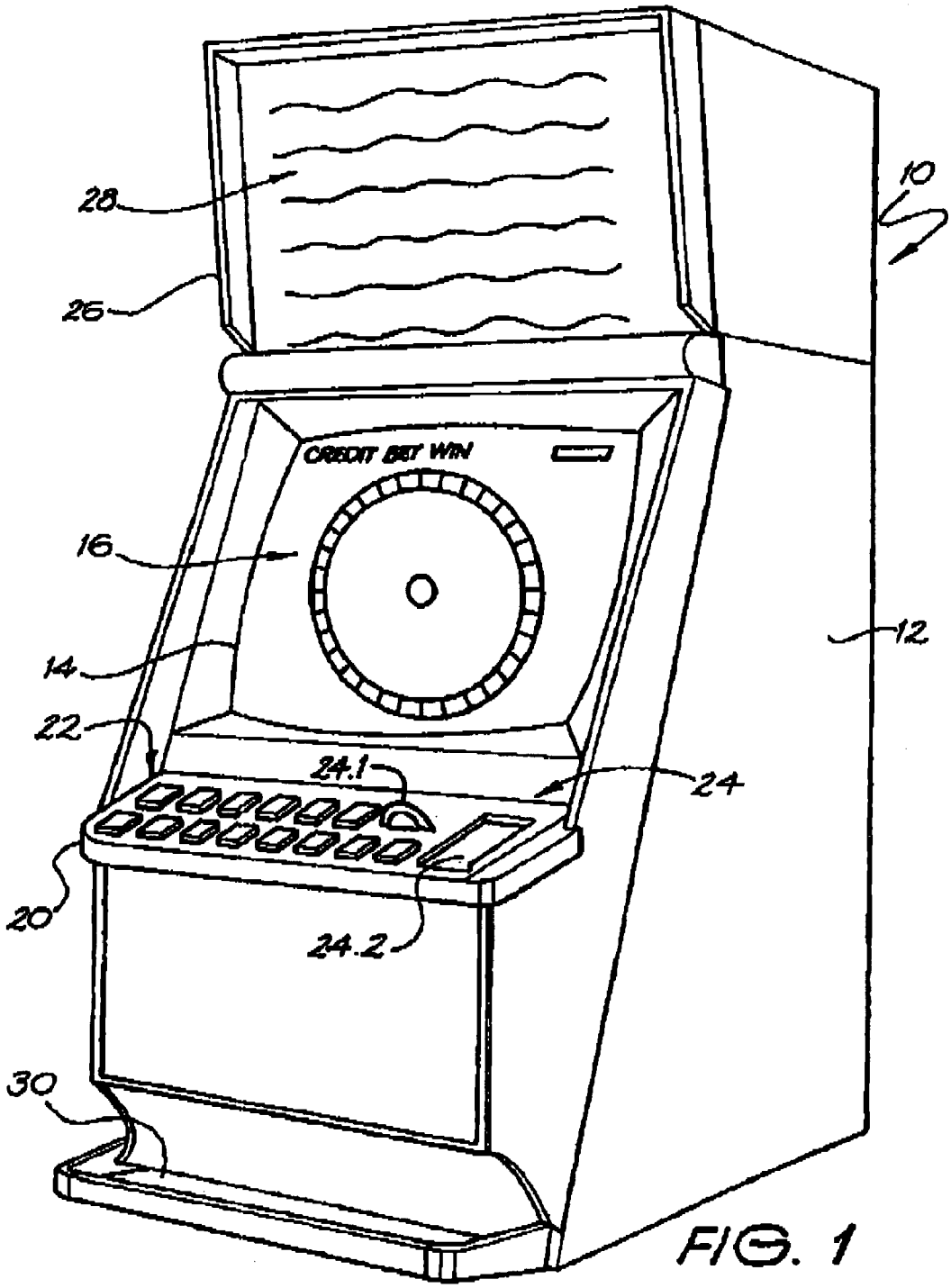
FIG. 1 shows a three dimensional view of an electronic gaming machine, in accordance with the invention.

In FIG. 1, reference numeral 10 generally designates a gaming machine, including a game, in accordance with the invention. The machine 10 includes a console 12 having a video display unit 14 on which a game 16 is played, in use. In this example, the invention shall be described with reference to a gaming machine on which an electronic version of a roulette game 16 is played. A video simulation of a roulette wheel 18 is displayed on the screen of the video display unit 14. It will, however, be appreciated that the invention is equally applicable to other types of games, such as spinning reel games, card games or ball games such as keno, bingo, or the like.

A midtrim 20 of the machine 10 houses a bank 22 of buttons for enabling a player to play the game 16. The midtrim 20 also houses a credit input mechanism 24 including a coin input chute 24.1 and a bill collector 24.2.

The machine 10 includes a top box 26 on which artwork 28 is carried. The artwork 28 includes paytables, details of bonus awards, etc.

A coin tray 30 is mounted beneath the console 12 for cash payouts from the machine 10.

Figure 2:
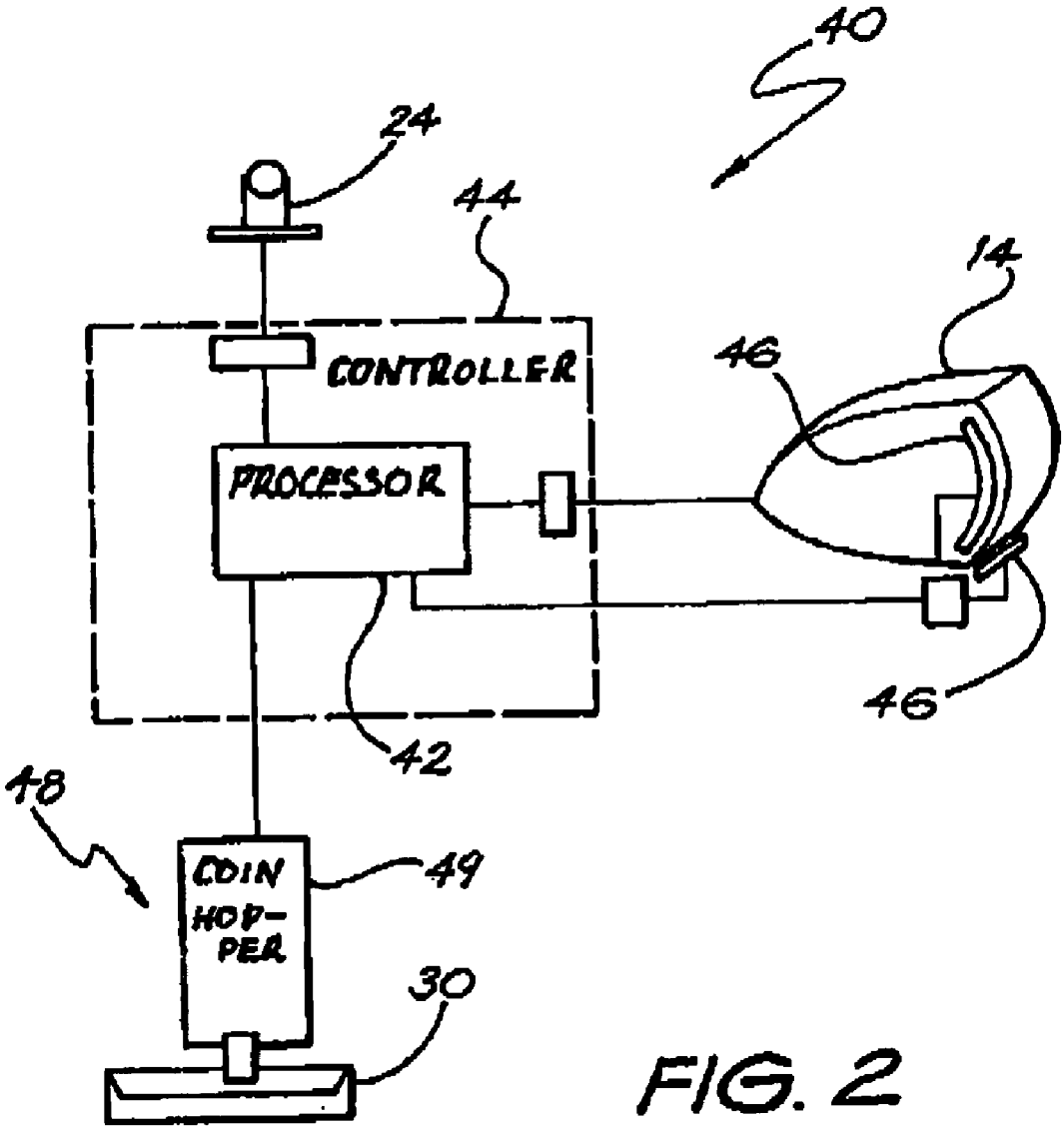
FIG. 2 shows a block diagram of a control circuit of the gaming machine of FIG. 1.
Figure 3:
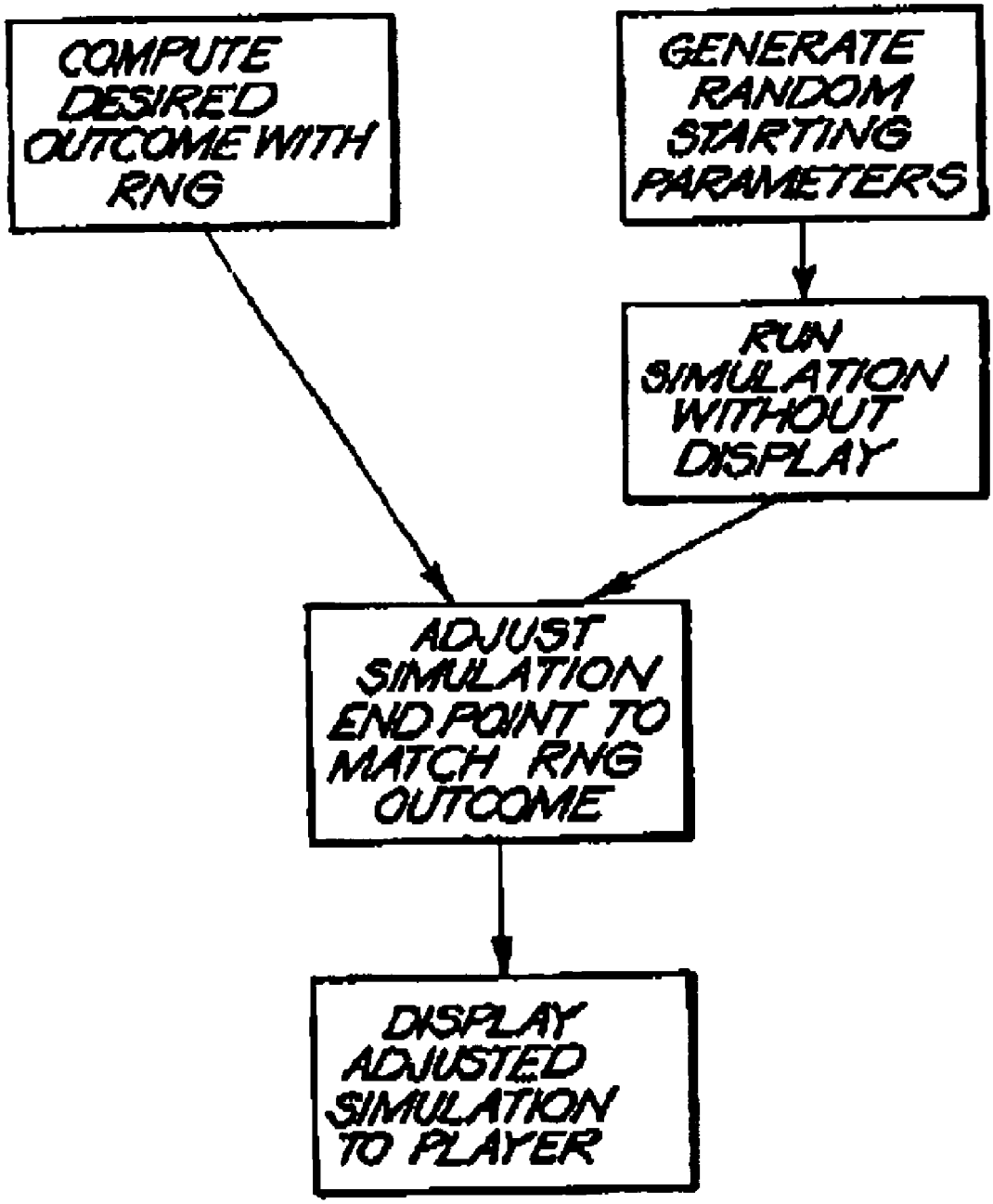
FIG. 3 shows a flow chart of the simulation system of the gaming machine of FIG. 1.

Referring now to FIG. 2 of the drawings, a control means or control circuit 40 is illustrated. A program which implements the game and user interface is run on a processor 42 of the control circuit 40. The processor 42 forms part of a controller 44 which drives the screen of the video display unit 14 and which receives input signals from sensors 46. The sensors 46 include sensors associated with the bank 22 of buttons and touch sensors mounted in the screen 16. The controller 44 also receives input pulses from the mechanism 24 indicating that a player has provided sufficient credit to commence playing. The mechanism 24 may, instead of the coin input chute 24.1 or the bill collector 24.2, or in addition thereto, be a credit card reader (not shown) or any other type of validation device.

The controller 44 drives a payout mechanism 48 which, for example, may be a coin hopper for feeding coins to the coin tray 30 to make a pay out to a player when the player wishes to redeem his or her credit.

The processor 42 of the controller 44 also incorporates a simulation system. The simulation system is used in real time physical modelling of predetermined outcomes of the game 16 played on the gaming machine. The simulation system is software implemented and is also used to drive the display of a graphical outcome for the game 16. However, as described in greater detail below, a first running of the simulation occurs before any outcome is displayed.

Also, in a conventional fashion, the processor 42 incorporates a pseudo-random or hardware based random number generator for generating a desired outcome of the game 16.

In the implementation of the simulation system of the processor 42, random starting parameters for running of the simulation system are chosen and set. These starting parameters are selected to fall within ranges that are known to produce pleasingly random looking results. Accordingly, the starting parameters may be derived from a set of starting parameters stored in a storage device of the controller 44.

Once the starting parameters have been set, an initial run of the simulation by the processor 42 takes place without the initial run being displayed. The simulation is run until an end condition is arrived at.

Simultaneously with the initial running of the simulation, or thereafter, the processor 42 generates a random number via its random number generator (RNG) and, using this RNG, a desired outcome of the game 16 is computed. Once a desired outcome has been determined using the selected RNG, the end condition arrived at after the initial running of the simulation and the desired outcome are compared by a comparator in the processor 42.

The starting parameters of the simulation are then adjusted by the processor 42. The previously used starting parameters are adjusted by using a mapping function or by being adjusted by a discrete amount. The discrete amount or mapping function is computed from the difference between the now known end condition of the simulation and the derived, desired outcome for the game 16.

Once the starting parameters of the simulation have been adjusted, the simulation is re-run using the adjusted starting parameters. This time, the running of the simulation is displayed on the video display unit 14 as the simulation progresses. Since the starting parameters have been adjusted so that the end condition of the simulation matches the desired outcome, once the simulation ends, the gaming machine 10 is in the correct end state for the desired outcome of the game 16.

An implementation of the above system is described with reference to an electronic version of a roulette game 16.

In the same way as other gaming machines, a player wagers a bet using the buttons of the bank 22 of buttons on the midtrim 20 of the gaming machine. These buttons are also used for the player to select his or her choice of the desired outcome and the game then commences by causing the roulette wheel 18 to commence spinning.

The first step of the implementation of the simulation system is to compute a set of random starting parameters. In the case of roulette, the starting parameters include the point at which the "croupier" releases the roulette ball, the initial rotational position and velocity of the roulette wheel 18 and the velocity and acceleration of the ball as vectors in three dimensional space. All of these parameters are within predetermined acceptable ranges so that there would be a maximum and minimum initial rotational velocity of the roulette wheel 18, for example.

Using these starting parameters, the simulation system is run. This simulates the releasing of the ball from the croupier's hand, the ball bouncing around the wheel and determining where the ball comes to rest in one of the thirty seven slots on the roulette wheel 18. This simulation is performed as quickly as the processor 42 can allow and without any means of the player knowing it is taking place. Independently of the running of the simulation and as would be done with a conventional gaming machine 10, a pseudo-random or true random number generator is used to compute a non-biased random number representing the desired outcome for the roulette game 16. For roulette, this would be a number between zero and thirty six or, where a double zero slot is also provided on the roulette wheel, a number between zero and thirty seven.

Accordingly, once the initial, simulated end position of the ball has been determined by the simulation and the desired outcome of the game has been determined by the selection of the random number, a comparison is made by a comparator of the processor 42 between the end condition of the initial simulation run and the desired outcome. If the end condition of the initial run of the simulation does not coincide with the desired outcome, the initial starting parameters of the simulation are adjusted so that the end condition of the simulation coincides with the now known desired outcome of the game.

The adjustment is effected by changing the mapping of the numbers on the simulated roulette wheel 18 by rotating these numbers around the wheel by a factor of $$(R-P) \bmod (N)$$

where R is the desired outcome of the game;

P is the end condition of the initial simulation run; and

N is the number of slots on the simulated roulette wheel 18.

Practically, for example, if the simulation had led to an outcome being the slot of the wheel having the number "10" in which the ball comes to rest on the initial run of the simulation and the desired outcome of the game is the slot having the number "17", the initial starting position of the wheel 18 is rotated such that the number "17" is in the same starting position as the number "10" had been when the initial run was simulated.

As described above, the simulation is then re-run with all parameters the same as before except for the mapping factor which results in the predetermined outcome R being produced by the simulation system. Also, when the simulation is re-run it is displayed on the display of the video display unit 14 so that the player can watch it in action and be able to enjoy the apparent behaviour of a complex physical simulation with all the quirks and randomness yet with a completely predetermined, non-biased outcome.

It will readily be appreciated that similar adjustments can be made in other games played on electronic gaming machines, such as, for example, in the case of bingo the numbering of the predetermined bingo ball is swapped with the physical simulation end result bingo ball.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A gaming machine having a display and a game controller, said game controller being arranged to provide:

a simulation system configured to generate a game display which corresponds to a pre-calculated outcome for a game; said simulation system being adapted to run an initial simulation that simulates the playing of the game from start to finish without displaying the outcome of the initial simulation, the simulation system enabling predetermined starting parameters to be set;

a comparator for comparing an end condition of said initial simulation run by the simulation system with the pre-calculated outcome of the game; and an adjustment means for adjusting the starting parameters used by the simulation system in a subsequent simulation of the game that is used for generating the game display for the game, such that the end condition of the subsequent simulation of the game corresponds to the pre-calculated outcome for the game.

2. The gaming machine of claim 1 in which the simulation system is software based.

3. The gaming machine of claim 2 in which the simulation system is used as a means to drive a display of a graphical outcome for the game.

4. The gaming machine of claim 2 which includes a control means for controlling playing of the game.

5. The gaming machine of claim 4 in which at least part of the control means includes a random number generator for generating random numbers.

6. The gaming machine of claim 5 in which the random number generator is one of a pseudo-random number generator and a hardware based random number generator.

7. The gaming machine of claim 4 in which the simulation system is implemented in the control means by a processing means.

8. The gaming machine of claim 7 in which the processing means includes simulation software to perform the simulation and running of the initial and subsequent simulations.

9. The gaming machine of claim 8 in which the simulation software sets random starting parameters for the initial simulation.

10. A method of displaying an outcome of a game played on a gaming machine, the method including the steps of;

setting starting parameters for an initial simulation of the game;

performing the initial simulation of the game using said starting parameters without displaying the outcome of the initial simulation to a user;

determining an end condition of the initial simulation;

comparing the end condition of the initial simulation with a pre-calculated outcome of the game;

adjusting the starting parameters of the initial simulation as a result of the comparing, such that the end condition of a subsequent simulation of the game using the adjusted starting parameters will correspond to the pre-calculated outcome for the game; and performing a subsequent simulation of the game using said adjusted starting parameters; and displaying the outcome of the subsequent simulation, corresponding to the pre-calculated outcome for the game, to the user as the display of the outcome of the game.

11. The method of claim 10 which includes setting random starting parameters for the initial simulation.

12. The method of claim 11 which includes running the initial simulation through once until the end condition is arrived at, without displaying the end condition on a display means of the gaming machine.

13. The method of claim 12 which includes performing one of a pseudo-random calculation and a truly random calculation to derive the desired outcome for the game.

14. The method of claim 13 which includes, once the initial simulation's end condition has been arrived at and the pre-calculated outcome for the game has been determined, adjusting the starting parameters by one of a discrete amount and a mapping function.

15. The method of claim 14 which includes, adjusting the starting parameters using a difference between the now known end condition of the initial simulation and the pre-calculated outcome for the game.

16. The method of claim 15 which includes running the subsequent simulation using the adjusted starting parameters.

17. The method of claim 16 which includes displaying the subsequent simulation as the subsequent simulation progresses.

* * * * *